US006209300B1

(12) United States Patent
Stahlecker

(10) Patent No.: US 6,209,300 B1
(45) Date of Patent: Apr. 3, 2001

(54) APPARATUS FOR PNEUMATIC CONDENSING OF A DRAFTED FIBER STRAND AND METHOD OF MAKING AND USING SAME

(75) Inventor: Hans Stahlecker, Haldenstrasse 20, 73079 Suessen (DE)

(73) Assignees: Fritz Stahlecker, Bad Uberkingen; Hans Stahlecker, Süssen, both of (DE)

( * ) Notice: Subject to any disclaimer, the term of this patent is extended or adjusted under 35 U.S.C. 154(b) by 0 days.

(21) Appl. No.: 09/479,058

(22) Filed: Jan. 7, 2000

(30) Foreign Application Priority Data

Jan. 14, 1999 (GB) ..... 19901148
May 21, 1999 (GB) ..... 19923396

(51) Int. Cl.[7] ..... D01H 7/46
(52) U.S. Cl. ..... 57/264; 57/315; 57/328
(58) Field of Search ..... 19/150, 236–251, 19/252, 263, 258, 286, 287, 288, 304–308; 57/264, 304, 315, 328, 333

(56) References Cited

U.S. PATENT DOCUMENTS 3,296,664 * 1/1967 Ingham, Jr. et al. ..... 19/236
4,488,397 12/1984 Venot .
4,953,349 * 9/1990 Fehrer ..... 57/315
5,085,046 * 2/1992 Fehrer ..... 57/315
5,090,192 * 2/1992 Stahlecker ..... 57/328
5,157,911 * 10/1992 Stahlecker et al. ..... 57/328
5,175,991 * 1/1993 Stahlecker ..... 57/328
5,285,624 * 2/1994 Stahlecker ..... 57/328
5,431,005 * 7/1995 Fehrer ..... 57/315
5,617,714 * 4/1997 Fehrer ..... 57/315
5,651,244 * 7/1997 Lucca et al. ..... 57/315
5,996,181 * 12/1999 Fuchs ..... 19/150

FOREIGN PATENT DOCUMENTS

4139067A1 6/1993 (DE) .

* cited by examiner

*Primary Examiner*—John J. Calvert
*Assistant Examiner*—Gary L. Welch
(74) *Attorney, Agent, or Firm*—Evenson, McKeown, Edwards & Lenahan, P.L.L.C.

(57) ABSTRACT

A condensing zone for pneumatic condensing of the drafted, still twist-free fiber strand is arranged downstream of the drafting apparatus of a ring spinning machine. The condensing zone is limited by a delivery roller pair, whose driven bottom roller is a suction roller, which is arranged directly downstream of the front roller pair of the drafting apparatus. The fiber strand loops the suction roller at an angle of at least 45°.

19 Claims, 3 Drawing Sheets

APPARATUS FOR PNEUMATIC CONDENSING OF A DRAFTED FIBER STRAND AND METHOD OF MAKING AND USING SAME

BACKGROUND AND SUMMARY OF THE INVENTION

This application claims the priority of German application 199 01 148.6, filed in Germany on Jan. 14, 1999, and German application 199 23 396.9 filed in Germany on May 21, 1999, the disclosure of which is expressly incorporated by reference herein.

The present invention relates to an apparatus for pneumatic condensing of a drafted fiber strand in a condensing zone arranged downstream of a front roller pair of a drafting apparatus, which condensing zone is limited in transport direction of the fiber strand by the nipping line of a delivery roller pair, said nipping line forming a twist block, and said delivery roller pair comprising a perforated suction roller, in whose inside a suction slit is arranged which extends essentially in transport direction to the nipping line.

An apparatus of this type is prior art in German published patent application 41 39 067. In the case of this apparatus, an apron pair is arranged around the front roller pair of the drafting apparatus, which apron pair guides the fiber strand exiting from the front roller pair into the condensing zone. The bottom apron of this apron pair is also guided over the bottom roller of the delivery roller pair. The upper roller of the delivery roller pair has suction openings and is thus in the form of a suction roller. The suction roller is not surrounded by the upper apron of the apron pair.

This apron pair, which loops the front roller pair of the drafting apparatus, requires, for a faultless drafting clamping of the fiber strand at the drafting apparatus, high pressures, which are higher than pressures in standard drafting apparatuses and which pressures diminish the life duration of the apron pair. In the zone where the fiber strand is double-guided by the apron pair, no condensing as yet takes place, as this can occur at the earliest at the suction roller. Because the bottom apron of the apron pair loops the bottom roller of the front roller pair as well as the bottom roller of the delivery pair, no differing peripheral speeds for an eventual tension draft between the front roller pair and the delivery roller pair can be set.

It is known from U.S. Pat. No. 4,488,397 that downstream of the actual drafting apparatus a condensing element in the form of a suction roller is arranged. This suction roller comprises, however, for the drafted fiber strand, a peripheral groove, so that no nipping point, which would clamp the fiber strand, can be formed with the suction roller. The twist block should rather more be effected in that the fiber strand loops the suction roller at a certain angle, so that the spinning twist, retroactive back to the drafting apparatus, is increasingly lost. In the area of the looping, the perforation of the suction roller is not suctioned, so that in this area also no pneumatic condensing takes place. Rather, the condensing takes place mechanically by means of the V-shaped ring groove.

It is an object of the present invention to utilize the entire distance between the front roller pair of the drafting apparatus and the delivery roller pair for the condensing of the fiber strand, and to create the possibility of setting a tension draft.

This object has been achieved in accordance with the present invention in that the suction roller is disposed directly downstream of the front roller pair and in that the fiber strand loops the suction roller up to the nipping line at an angle of at least 45°.

As there is no apron pair present in the condensing zone, the condensing effect can begin directly downstream of the drafting apparatus. As a result of the relatively large looping of the suction roller, the condensing zone is sufficiently long. In addition, it is possible to drive the front roller pair and the delivery roller pair at different peripheral speeds.

It has been shown that it is favorable for the condensing effect when a drafting plane, defined by the drafting apparatus, at least approximates a tangential plane guiding the fiber strand to the suction roller. The fiber strand is thus not deflected on its way from the front roller pair of the drafting apparatus to the suction roller.

Other objects, advantages and novel features of the present invention will become apparent from the following detailed description of the invention when considered in conjunction with the accompanying drawings.

DETAILED DESCRIPTION OF THE DRAWINGS

Figure 1:
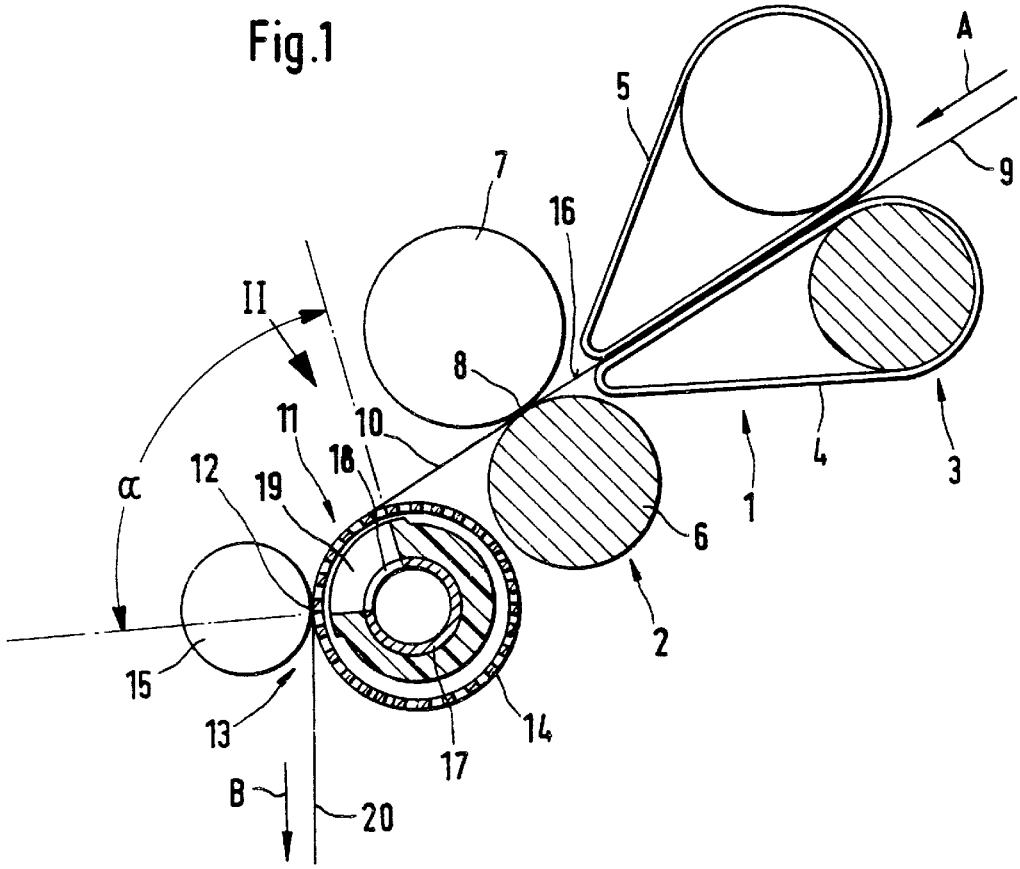
FIG. 1 is a partly sectional side view of an area of an apparatus constructed according to a preferred embodiment of the is present invention.
Figure 2:
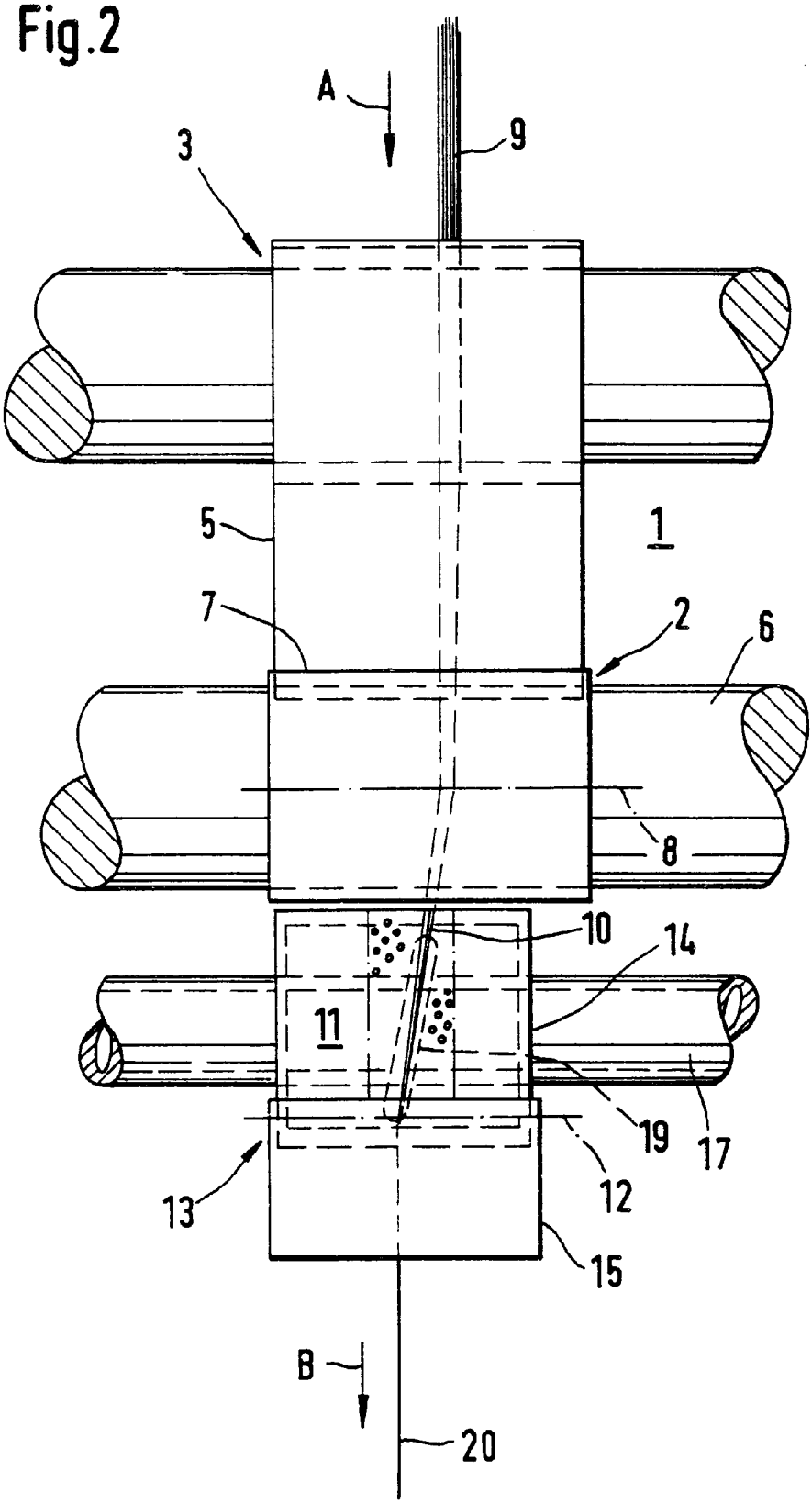
FIG. 2 is a view in the direction of arrow II of FIG. 1.

The drafting apparatus 1 only partly shown in FIGS. 1 and 2 comprises a front roller pair 2 and an apron roller pair 3 arranged upstream thereof. Further roller pairs are not shown. The apron roller pair 3 guides in a known way a bottom apron 4 and an upper apron 5.

The front roller pair 2 comprises a front bottom roller 6, which extends in machine longitudinal direction and is driven. At each spinning station, a front top roller 7 is flexibly or elastically pressed onto the front bottom roller 6, whereby two front top rollers of adjacent spinning aggregates jointly form so-called top roller twins. The front roller pair 2 of the drafting apparatus 1 forms a front nipping line 8, at which the drafting of the fiber material is ended.

A sliver or roving 9 is guided through the drafting apparatus 1 in transport direction A and drafted to the desired degree of fineness. Downstream of the front nipping line 8, a drafted, but still twist-free fiber strand 10 is present.

The drafted fiber strand 10 is guided downstream of the drafting apparatus 1 through a condensing zone 11, where pneumatic condensing takes place. The purpose of the condensing is to bundle the fiber strand 10 so that it is smaller in diameter and less hairy, as outwardly projecting edge fibers are rolled in around the core strand. A thread or yarn 20 formed from the strand and emerging from the condensing zone 11 is more tear-resistant, more even and relatively smooth as compared to yarn formed without such condensing.

The condensing zone 11 is bordered on its exit side by a nipping line 12, which is defined by a delivery roller pair 13. This nipping line 12 serves at the same time as a twist block for the spinning twist retroactive from a twist device (not shown), for example a ring spindle.

The delivery roller pair 13 comprises as a bottom roller a driven suction roller 14, which, on its periphery, at least in the fiber guiding area, is perforated and thus air-permeable. The suction roller 14 is arranged directly downstream of the front roller pair 2 of the drafting apparatus 1. Arranged directly at the suction roller 14 is a nipping roller 15, whose clamping pressure is weaker than the clamping pressure at the front roller pair 2. The nipping roller 15 forms the upper roller of the delivery roller pair 13 and is so arranged that the fiber strand 10 to be condensed loops the suction roller 14 in the condensing zone 11 at an angle α of at least 45°.

It is favorable when the tangential plane, the so-called drafting plane 16, formed by the nipping lines of the apron roller pair 3 and the front roller pair 2, also forms the tangential plane which guides the fiber strand 10 to the suction roller 14. The fiber strand 10 which is to be condensed is thus not deflected between the front nipping line 8 and the suction roller 14, but rather only then, when it is transported onto the periphery of the suction roller 14.

It has been shown that this has a favorable effect on the quality of the thread 20 to be spun.

The suction roller 14 is supported in a way not shown on a stationary suction tube 17 extending in machine longitudinal direction. In the inside of each suction roller 14, the suction tube 17 comprises a suction opening 18 directed against the condensing zone 11, at which suction opening 18 a suction slit 19, decisive for the condensing effect, is arranged. The suction slit 19 is significantly wider than the condensed fiber strand 10 and extends essentially in transport direction A, or at a slight angle to transport the direction A. The suction slit 19 begins at the latest there, where the fiber strand 10 is disposed onto the suction roller 14, and extends up to the nipping line 12. Thus the condensing effect is maintained in any case up to the nipping line 12.

Downstream of the nipping line 12, the condensed fiber strand in the form of a forming yarn 20 is fed in delivery direction B to a ring spindle (not shown). The spinning twist imparted by the ring spindle is retroactive to the nipping line 12.

Because the suction roller 14 is directly downstream of the front roller pair 2, the condensing of the fiber strand 10 takes place directly downstream of the front nipping line 8. Because the fiber strand 10 loops the suction roller 14 at an angle of at least 45°, the condensing zone 11 is sufficiently long.

As, in contrast to the above mentioned prior art, no inevitable coupling as regards a drive is present between the front bottom roller 6 and the suction roller 14, the drives can be created independently of one another as required. It is therefore possible to run the delivery roller pair 13 at a higher speed than the front roller pair 2, so that the fiber strand to be condensed experiences a low tension draft.

Figure 3:
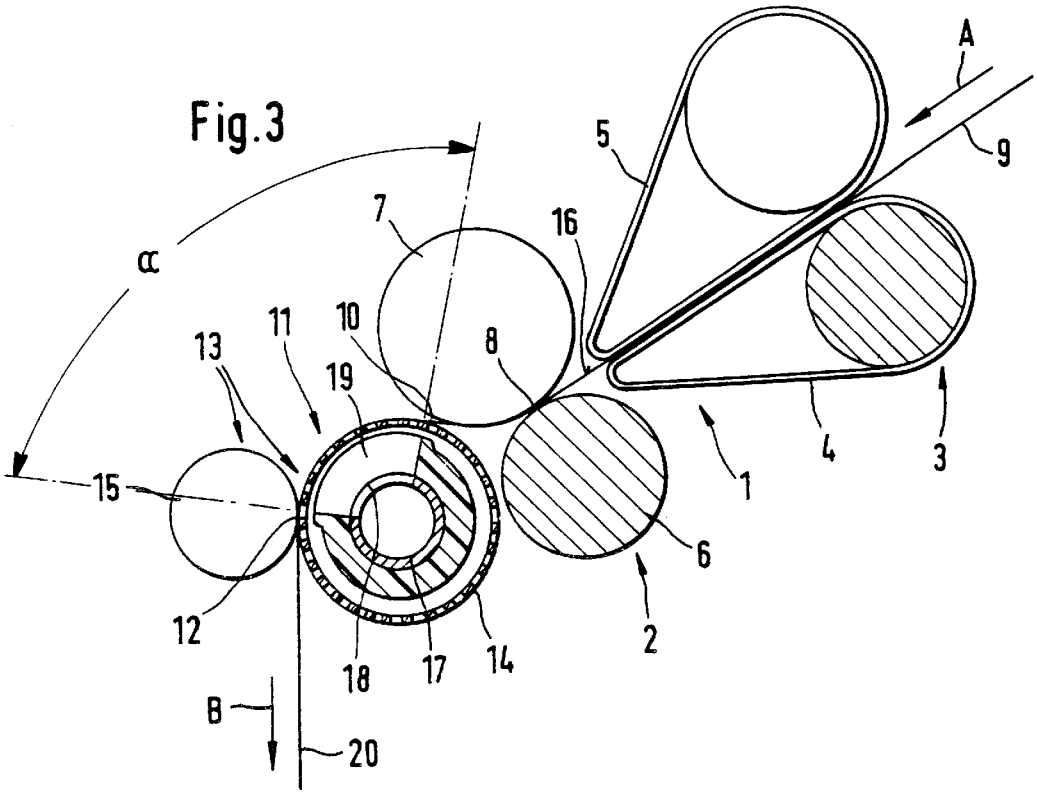
FIG. 3 is a view similar to FIG. 1 of another embodiment of the present invention.

The embodiment of the present, invention according to FIG. 3 differs from the embodiment shown in FIGS. 1 and 2 only in that the suction roller 14 takes up a somewhat different position in relation to the front roller pair 2 of the drafting apparatus 1. For this reason a repeat description of the individual components is not necessary.

According to FIG. 3, the drafting plane 16 of the drafting apparatus 1 is no longer the tangential plane which guides the fiber strand 10 to the suction roller 14. This has the advantage that the suction roller 14 can be advanced nearer to the front nipping line 8, so that the condensing effect for the drafted fiber strand 10 begins earlier. However, a slight deflection for the fiber strand 10 before reaching the suction roller 14 must be accepted.

Figure 4:
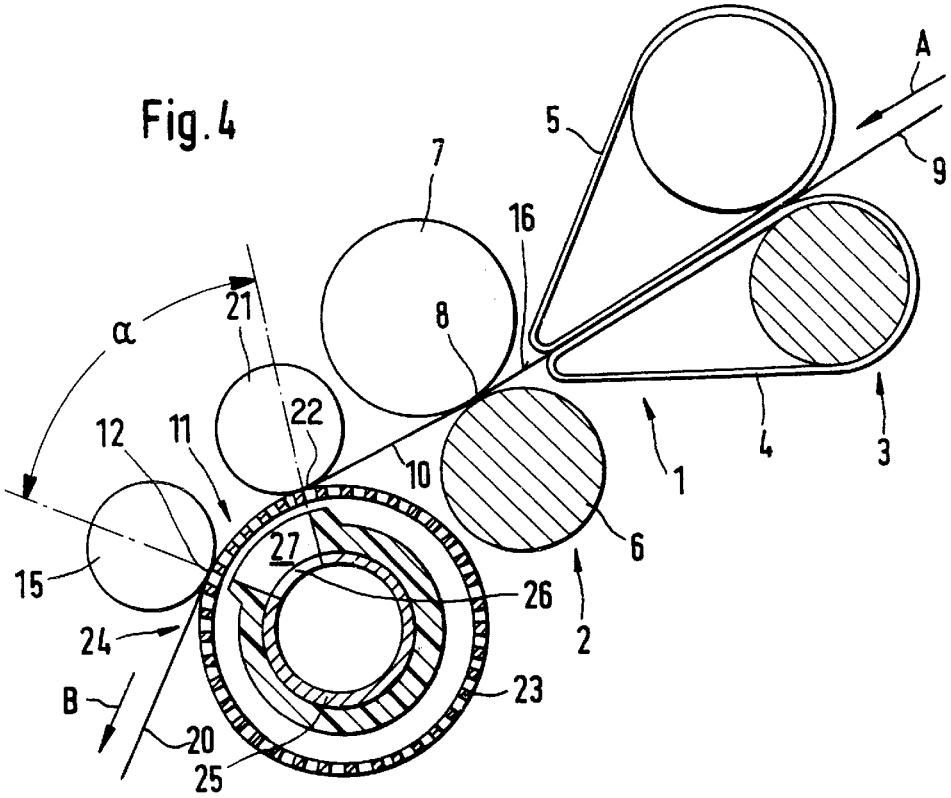
FIG. 4 is a view similar to FIG. 1 having a suction roller with a large diameter to which two nipping rollers are arranged.

In the embodiment of the present invention shown in FIG. 4 a suction roller 23 is provided whose diameter is significantly larger compared to the diameters of the front roller pair 2 of the drafting apparatus 1. Thus the curve of the roller surface in the area of the condensing zone 11 can be advantageously reduced. The suction roller 23 forms, together with a nipping roller 15 which borders the exit side of the condensing zone 11, the delivery roller pair 24.

Due to the large diameter of the suction roller 23, the condensing zone 11 is bordered also on its entry side by a nipping roller 21, so that the condensing zone 11 is now located between two nipping lines 22 and 12. The looping of the suction roller 23 again measures an angle of at least 45°.

As in the above embodiments of the present invention, the suction roller 23 is also supported on a stationary suction tube 25, which comprises a suction opening 26 directed against the condensing zone 11. The suction opening 26 is in contact with a suction slit 27, which extends essentially between the two nipping lines 22 and 12 in transport direction A of the fiber strand 10 to be condensed.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for pneumatic condensing of a drafted fiber strand in a condensing zone arranged downstream of a front roller pair disposed at an exit end of a drafting apparatus, which condensing zone is limited in transport direction of the fiber strand by a nipping line of a delivery roller pair, said nipping line forming a twist block, and said delivery roller pair comprising a perforated suction roller, in whose inside a suction slit is arranged which extends essentially in transport direction of the fiber strand to the nipping line, wherein the suction roller is disposed directly downstream of the front roller pair and is looped by the fiber strand to the nipping line at an angle of at least 45°.

2. An apparatus according to claim 1, wherein a drafting plane defined by the drafting apparatus extends substantially in a tangential plane which guides the fiber strand to the suction roller.

3. An apparatus according to claim 2, wherein the suction roller can be driven at different peripheral speeds in relation to the front roller pair of the drafting apparatus.

4. An apparatus according to claim 1, wherein the suction roller can be driven at different peripheral speeds in relation to the front roller pair of the drafting apparatus.

5. An apparatus according to claim 4, wherein the suction roller is a driven bottom roller of the delivery roller pair .

6. An apparatus according to claim 5, wherein the suction roller has a significantly larger diameter in comparison to the rollers of the front roller pair of the drafting apparatus.

7. An apparatus according to claim 4, wherein the suction roller is a driven bottom roller of the delivery roller pair.

8. An apparatus according to claim 7, wherein the suction roller has a significantly larger diameter in comparison to the rollers of the front roller pair of the drafting apparatus.

9. An apparatus according to claim 8, wherein two nipping rollers bordering entry and exit sides of the condensing zone are arranged at the suction roller.

10. An apparatus according to claim 4, wherein the suction roller has a significantly larger diameter in comparison to the rollers of the front roller pair of the drafting apparatus.

11. An apparatus according to claim 10, wherein two nipping rollers bordering entry and exit sides of the condensing zone are arranged at the suction roller.

12. An apparatus according to claim 1, wherein the suction roller has a significantly larger diameter in comparison to the rollers of the front roller pair of the drafting apparatus.

13. An apparatus according to claim 12, wherein two nipping rollers bordering entry and exit sides of the condensing zone are arranged at the suction roller.

14. A method of making yarn comprising:

drafting sliver to form an untwisted fiber strand in a drafting unit which has a front roller pair at its exit end, pneumatically condensing the fiber strand in a condensing zone extending over a portion of a circumference of a perforated suction roller, said condensing zone being limited at its downstream end by a nipping line on the suction roller, and feeding the condensed fiber strand to a twist device with the nipping line forming a twist block, providing a suction roller disposed directly downstream of the front roller pair and looping the fiber strand over the suction roller to the nipping line at an angle of at least 45°.

15. A method according to claim 14, comprising providing a drafting plane defined by the drafting apparatus to extend substantially in a a tangential plane which guides the fiber strand to the suction roller.

16. A method according to claim 14, comprising driving the suction roller at different peripheral speeds in relation to the front roller pair of the drafting apparatus.

17. A method according to claim 16, comprising forming the nipping line by a top delivery roller engaging the suction roller at the nipping line.

18. A method according to claim 14, comprising forming the nipping line by a top delivery roller engaging the suction roller at the nipping line.

19. A method according to claim 14, comprising arranging two nipping rollers bordering entry and exit sides of the condensing zone at the suction roller.

* * * * *